US005421519A

United States Patent [19]

Woods

[11] Patent Number: 5,421,519

[45] Date of Patent: Jun. 6, 1995

[54] ADJUSTABLE NOZZLE

[76] Inventor: John R. Woods, 4540 Willens Ave., Woodland Hills, Calif. 91364

[21] Appl. No.: 231,464

[22] Filed: Apr. 22, 1994

[51] Int. Cl.[6] ..... B05B 1/12

[52] U.S. Cl. ..... 239/394; 222/402.17

[58] Field of Search ..... 239/390, 394, 73, 392; 222/527, 529, 402.17

[56] References Cited

U.S. PATENT DOCUMENTS

| | | | |
|---|---|---|---|
| 2,388,093 | 10/1945 | Smith | 239/394 |
| 2,790,680 | 4/1957 | Rosholt | 239/394 |
| 3,342,382 | 9/1967 | Huling | 222/402.17 |
| 3,377,028 | 4/1968 | Bruggeman | 239/394 |
| 3,596,835 | 8/1971 | Smith | 239/394 |
| 3,704,831 | 12/1972 | Clark | 239/394 |
| 3,814,326 | 6/1974 | Bartlett | 239/394 |
| 3,891,128 | 6/1975 | Smrt | 239/394 |
| 3,982,698 | 9/1976 | Anderson | 239/394 |
| 5,100,055 | 3/1992 | Rokitenetz | 239/525 |
| 5,307,864 | 5/1994 | Toth | 222/527 |

FOREIGN PATENT DOCUMENTS

| | | | |
|---|---|---|---|
| 1586067 | 2/1970 | France | 239/394 |
| 867713 | 5/1961 | United Kingdom | 239/394 |
| 1144385 | 3/1969 | United Kingdom | 222/527 |

*Primary Examiner*—Andres Kashnikow
*Assistant Examiner*—Christopher G. Trainor
*Attorney, Agent, or Firm*—Roger A. Marrs

[57] ABSTRACT

An adjustable nozzle is disclosed herein to be carried on the end of a hollow supply tube detachably connected to the discharge nozzle of a pressurized spray container. The adjustable nozzle includes a member fixed to the tube having an open-ended passageway coextensive with the tube and which rotatably mounts, a discharge element having multiple fluid discharge orifices arranged in fixed spaced-apart relationship and of different shapes, diameters or sizes. Mated ribs and grooves are provided on the discharge element and the member for rotatably maintaining selective relationship between one of the discharge orifices and the supply tube and a yieldable retaining device registers or indexes the selected discharge orifice with the supply tube.

3 Claims, 1 Drawing Sheet

ADJUSTABLE NOZZLE

BACKGROUND OF THE INVENTION

1. Field of the Invention

The present invention relates to the field of fluid discharge devices or dispensers, and more particularly to a novel adjustable nozzle detachably connected to a pressurized supply of fluid substance held in a container and intended to be held in one hand by the user in a variety of orientations for substance distribution.

2. Brief Description of the Prior Art

In the past, it has been the usual practice to distribute a substance from a pressurized container onto a supporting surface by using a finger depressible spray nozzle which is pointed directly at the support so that discharge of the substance will be distributed as the user moves the container. Such a discharge nozzle is conventional and is associated with most aerosol containers for substances such as paint, oils, window washes or the like. The conventional spray nozzle discharges the substance at a 90 degree angle with respect to the longitudinal center line of the container. The discharge orifice on the conventional nozzle produces a wide spray so that the area to be covered by the substance is widely served. However, in other instances, a linear open-ended tube or straw-like member is introduced into the discharge orifice of the nozzle so that a reduced spray or stream of substance issues from the end of the tube onto the supporting surface.

Problems and difficulties have been encountered when employing such conventional spray nozzles and tube extensions, which stem largely from the fact that bulky and semi-fluid substances are not readily discharged through the extension tube and the discharge nozzle orifice sometimes clogs or otherwise permits the buildup of substance which eventually blocks or prevents distribution of the substance onto the supporting surface. In other instances, only a single diameter of tube and orifice shape is available and consequently there can be no adjustment as to distribution of semi-fluid or fluid materials or substances. The single diameter and shape of discharge orifice determines the spray density as well as substance distribution onto the receiving surface. No single discharge orifice size nor selection of alternate sized tubing will permit proper distribution of a semi-fluid or fluid substance for all application needs.

Prior attempts have been made to provide a variety of separate tubes or straws having different sized diameters. However, multiple tubes or straws require experimental usage by trial and error until a proper sized tube has been found. This procedure is time-consuming and also allows loss or misplacement of the individual tubes in a set.

Therefore, a long-standing need has existed to provide a novel discharge nozzle which is adjustable so as to permit selection of a variety of different sized discharge orifices to be aligned with the supply passageway in a discharge tube or straw so that the proper texture of semi-fluid or fluid can be matched with the ceiling texture and clogging, accumulation of substance or undesired dripping from the nozzle are all prevented and eliminated. Preferably, the adjustable nozzle should be adapted for detachable connection to a spray container and permit discharge of the substance through the discharge nozzle while the spray container is held in one hand and in a vertical orientation even though the area to be sprayed with the substance is normal to the vertical spray container orientation.

SUMMARY OF THE INVENTION

Accordingly, the above problems and difficulties are avoided by the present invention which provides a novel adjustable nozzle for distributing a quantity of fluid or semi-fluid substance onto a supporting surface and which is adjustable by the user to select a desired sized discharge orifice. The adjustable nozzle includes an elongated supply tube or straw which may either be curved or linear and which has open ends whereby one end is detachably connected to the discharge nozzle of a spray container while its opposite end supports a stationary mount or member on which a rotatable discharge disc cap is movably carried. The mount or member includes an open-ended passageway in coextensive alignment with the supply tube or straw and includes guiding mounting means for supporting the discharge disc or cap is movably disc will rotate at the finger selection of the user. The discharge disc includes multiple different shaped, sized or diametered discharge orifices which are placed in selective alignment with the passageway in the mount or member permitting discharge of the fluid substance from the spray container. Stop means or limit means are provided on the discharge disc and mount or member so that alignment of the selected discharge orifice with the mount passageway is maintained and whereby the disc or cap is held in releasable relationship therewith.

Therefore, it is among the primary objects of the present invention to provide a novel discharge nozzle or apparatus for a pressurized fluid or semi-fluid substance in a spray container which will permit the selection of discharge orifice size so that the user may readily select a desired shape and size from a variety provided on a nozzle for permitting discharge of the fluid or semi-fluid substance.

Another object of the present invention is to provide a novel adjustable discharge nozzle having multiple discharge orifices which are readily aligned with and selectively mated with a supply tube so that the substance to be distributed via the nozzle may be discharged from a selected one of the discharge orifices.

Still a further object of the present invention is to provide a novel adjustable spray nozzle having registration or indexing means for aligning a selective discharge orifice with a supply passageway.

A further object of the present invention resides in providing a discharge nozzle having selective discharge orifices connected to a pressurized spray container whereby the container may be held in one hand by the user and the spray nozzle is directed in a direction normal or angled with respect to the central longitudinal axis of the spray container.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
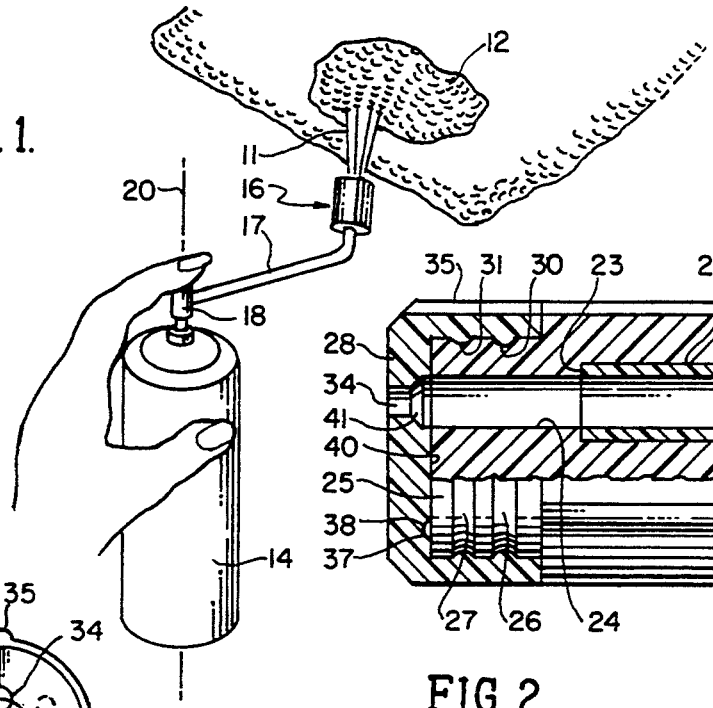
FIG. 1 is a perspective view showing the adjustable nozzle of the present invention used in combination with a spray container of pressurized substance.

Referring to FIG. 1, a typical spray application of a semi-fluid or fluid substance 11 is illustrated as being applied to an area 12 intended to be covered with the substance. The fluid may be viscous, such as oil, paint, window cleaner or the like, or may be semi-fiscous, as broadly represented as being bumpy, pebbled or presenting a popcorn appearance.

The substance or material is discharged from a dispenser 14 in the form of the spray 11 via an adjustable nozzle 16 carried on one end of a tube or straw 17. Application is achieved by depression of a pump or spray nozzle 18 which permits discharge of the substance under pressure from within the container 14. Such an application of the material is directly placed on the desired area by the user who holds the container 14 in one hand and operates the nozzle 18 on site with one finger of one hand. Wastage and loss of material is avoided since the discharge is under the control of the user through the application of the discharge nozzles 16 and 18. Therefore, there is no residue, unused or excess material which requires disposal.

To control discharge of the substance or material 15 and avoid wastage, distribution may be via the elongated straight, curved or arcuate open-ended hollow straw or tube 17 and the discharge nozzle 16. As shown, the straw is curved so that substance discharge is angled with respect to longitudinal axis of the container. The user may hold the dispenser container in a vertical or upright orientation with the end of the straw or tube carrying the adjustable nozzle 16 in close proximity to the servicing, lubricating or painting area. The other end of the straw or tube is pressed into an interference fit with the conventional discharge opening of the nozzle 18. Without the use of a curved straw or with a straight straw, the user must hold the container at an awkward angular position since the discharge from the dispenser nozzle 18 is always normal to the longitudinal vertical axis 20 of the dispenser.

Figure 2:
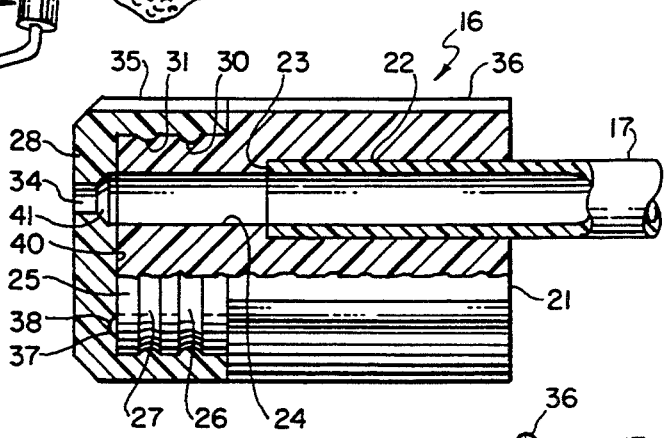
FIG. 2 is an enlarged longitudinal cross-sectional view of the adjustable nozzle used in the device of FIG. 1.

Referring to FIG. 2 in detail, it can be seen that the novel adjustable nozzle of the present invention is carried on the end of tube or straw 17. The adjustable nozzle includes a fixed or stationary mount or member 21 which includes an elongated bore 22 terminating in a shoulder 23 against which the open end of tube or straw 17 abuts when the end of the straw is force-fitted into the bore 22. The shoulder 23 serves as a stop so that the straw bottoms against the shoulder and cannot advance further into the mount. The length of the straw inserted into bore 22 is sufficient to support the nozzle 16 in a stationary position and the interference fit prevents withdrawal or detachment of the straw from the mount or member 21.

The mount or member 21 further includes a bore of reduced diameter, identified by numeral 24, which is coaxially disposed and coextensive with the bore 22 so as to be in alignment with the internal bore or passageway of the tube or straw 17. Extending from the end of the mount or member 21 surrounding and defining the bore 24 is a reduced shaft-like element 25 into which circular grooves are formed in fixed spaced-apart relationship and coaxial with bore 22. The grooves are represented by numerals 26 and 27 respectively.

Rotatably mounted on the shaft-like element 25 and having a recess into which a pair of circular ribs are disposed is a nozzle discharge disc or cap 28. The ribs are identified by numerals 30 and 31 which extend into the cap recess and reside in the parallel grooves 26 and 27 respectively. Therefore, it can be seen that the discharge element 28 is of a cap-like shape having an internal recess which is snap-locked over the shaft-like element 25 so that the ribs 30 and 31 snap into rotatable engagement with the grooves 26 and 27 respectively. In this fashion, the disc or cap 28 can rotate about the shaft-like element.

Figure 3:
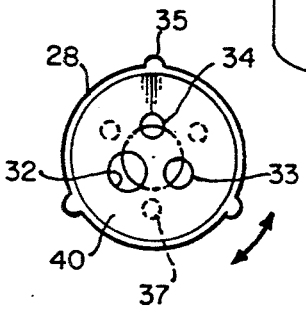
FIG. 3 is a front view of the adjustable nozzle shown in FIG. 2 illustrating the different sized discharge orifices.
Figure 4:
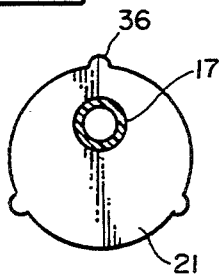
FIG. 4 is a rear elevational view of the adjustable nozzle shown in FIG. 2.

Referring now in detail to FIGS. 2 and 3, it can be seen that the discharge cap 28 includes multiple spaced-apart discharge orifices represented by numerals 32, 33 and 34 respectively. These discharge orifices are of different sizes, shapes or diameters so that the amount of substance 15 discharge from the nozzle 16 can be selectively controlled. The discharge orifices are placed radially in equal distance from the center or axis of rotation of the discharge cap 28 so that the selective rotation of the cap, a selected one of the discharge orifices may be placed in alignment with the bore 22 of the tube or straw and the coextensive bore 24. In FIG. 2, the smallest discharge orifice 34 is placed in alignment with the bore 24 so that complete fluid communication resides between the straw 17 and the open discharge orifice whereby the substance may be readily distributed therethrough. To align other discharge orifices with the bore 24, the user need only rotate cap 28 for proper alignment. In order to assist the user, it can be seen that the external surface of both the mount or member 21 and the cap 28 include external raised portions, such as raised portion 35 on cap 28 associated with the discharge orifice 34. The raised portions carried on the cap or disc 28 travel with the cap as it is rotated; however, similar raised portions, such as identified by numeral 36, are carried on the fixed mount or member 21 and these do not rotate but serve as alignment positions for registration with raised portions on the rotatable element 28. When alignment has been reached between the raised portions on the cap 28 and the raised portions on the mount or member 21, the user knows that a selected one of the discharge orifices is in alignment with the bore 24.

Also, to assist the user in determining alignment, it is to be seen that the cap or disc 28 includes three recesses or depressions 37 into which a raised nub 38 is selectively placed as the cap 28 is rotated. Therefore, the user can feel the engagement of the hub 38 with a selected one of the recesses 37 in cap 38, and this assists the user in aligning a selected one of the discharge orifices with the bore 24.

Referring now in detail to FIG. 3, it can be seen that the cap or disc 28 includes a wall 40 which terminates the cap recess through which the multiple discharge orifices are provided. It is to be especially noted in FIG. 2 that each of the discharge orifices and, as illustrated, orifice 34, is provided with an internal chamfer 41 that communicates each of the respective orifices with the bore 24 when the orifices are aligned therewith. The conical or chamfered portion 41 of each orifice conducts the substance from straw 17 and bore 24 in a non-restricted manner so that clogging is prevented. Also, the discharge orifices are properly aligned with the bore 24 when the internal chamfer or conical portion 41 is provided.

Figure 5:
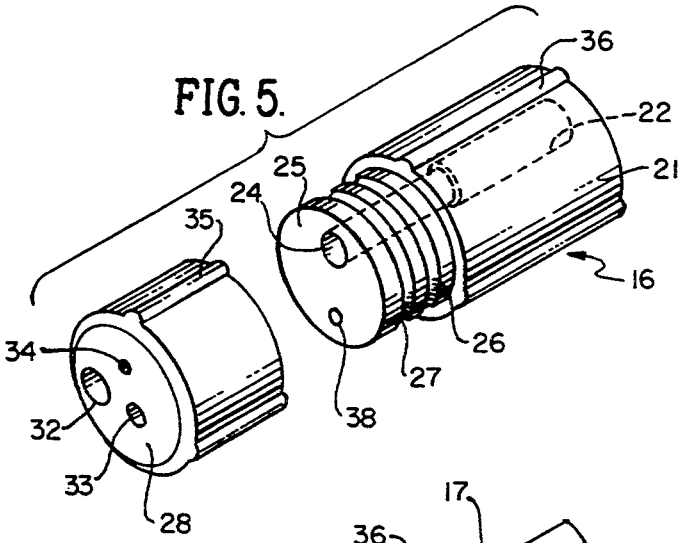
FIG. 5 is an exploded perspective view showing the rotatable discharge disc or cap and the fixed mount or member used in the adjustable nozzle shown in FIG. 2.
Figure 6:
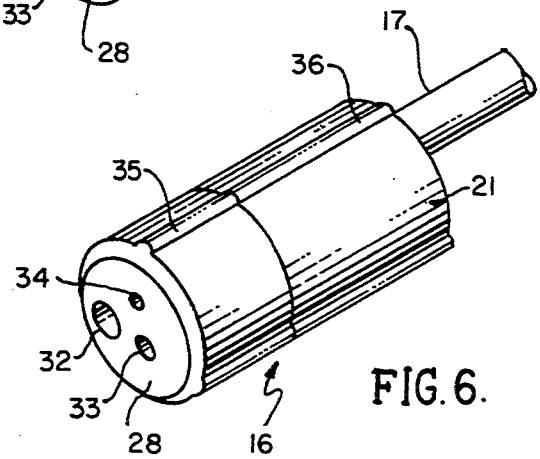
FIG. 6 is a view similar to the view of FIG. 5 in the fully assembled condition.

Referring now in detail to FIGS. 5 and 6, it can be seen that the cap 28 is removably disposed with respect to the member 21 and that the cap 28 slips over the shaft-like element 25. Also, it can be seen that the shape of the discharge orifice may be changed as shown in FIG. 3 wherein the shape of orifice 34 is somewhat different from the shape of the orifices 32 and 33.

As shown in FIG. 5, the cap 28 may be snapped over the shaft-like element 25 so that the ribs 31 and 32 snap into the grooves 26 and 27. The cap may rotate either clockwise or counterclockwise on the shaft-like element and the user can readily select one of several discharge orifices to be aligned with the bore 24. The finger ribs 36 and 35 can be readily aligned so as to register and index with a selected discharge orifice. Also, the nub 38 will snap into position with respect to grooves 37 on the wall 40 of the cap.

Referring to FIG. 6, a fully assembled nozzle incorporating the present invention is illustrated and it can be seen that it is carried on the end of straw or tube 17. As mentioned in the co-pending Patent application, as well as this application, the straw may be straight or it may be curved. When the straw is curved, as shown in FIG. 1, the container 14 may be held in one hand of the user in an upright position so that its longitudinal axis 20 is straight and vertical. By employing the curved straw 17, the discharge orifices of the nozzle 16 face in an angled position with respect to the longitudinal central axis and, in this manner, the spray 11 of the material may be distributed upon a ceiling or upper structure while the container 14 is held in the vertical position. Such orientation of the container is convenient to the user and the user need not bend his wrist or assume other bodily orientations in order to distribute the substance.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In an adjustable nozzle for discharging a fluid or semi-fluid substance from a pressurized container, the combination comprising:

a mount having opposite ends and with an open-ended bore terminating at said opposite ends of said mount;

a cap rotatably carried on a selected end of said mount opposite ends and having multiple discharge orifices selectively indexed with said open-ended bore in response to cap rotation;

index means cooperatively carried on said cap and said mount for aligning a selected one of said multiple discharge orifices with said open-ended bore;

said index means includes a plurality of recesses, each recess being associated with one of said multiple discharge orifices and a nub carried on said mount selectively engageable with said recesses in response to cap rotation;

said index means includes multiple external ribs carried on said mount and multiple external ribs carried on said cap and said cap ribs being selectively placed in alignment with said mount ribs to selectively index said discharge orifices with said open-ended bore;

said mount is cylindrical and includes a selected end of reduced diameter constituting a shaft-like member for rotatably supporting said cap thereon;

a pair of spaced-apart grooves provided in said shaft-like member coaxially disposed with respect to the central longitudinal axis of said mount;

a pair of spaced-apart internal ribs carried on said cap and said internal ribs occupying said pair of grooves respectively;

said cap includes a chamfered opening leading into each of said discharge orifices conducting fluid therethrough to said open-ended bore;

a container of pressurized substance;

a finger-operated nozzle carried on said container in releasable communication with said pressurized substance;

a tube having opposite ends with a selected end detachably carried on said finger-operated nozzle and said mount within said open-ended bore.

2. The invention as defined in claim 1 wherein:

said open-ended bore is of reduced diameter within said shaft-like member so as to provide an annular shoulder against which said tube abuts, said shoulder providing a stop for said tube.

3. In a fluid substance distribution means carried on a hand-held container with a finger-operated nozzle, the improvement which comprises:

an adjustable nozzle having at least three discharge orifices movably disposed with respect to a single open-ended bore;

an elongated curved tube having one end detachably connected to said finger-operated nozzle and its other end insertably receivable into said open-ended bore so as to conduct said fluid substance from said container to said adjustable nozzle;

selection means rotatably carried on said adjustable nozzle for aligning a selected one of said discharge orifices with said open-ended bore;

registration means carried on said adjustable nozzle for yieldably retaining said selected one of said discharge orifices in alignment with said open-ended bore;

said container has a central longitudinal axis and said tube is curved so as to have a curved central longitudinal axis with one end of said tube normal to said container central longitudinal axis and its other end parallel with said container central longitudinal axis;

said open-ended bore is offset from a linear central axis of said adjustable nozzle and said discharge orifices are disposed radially of said linear central axis so that said discharge orifices move sequentially past said open-ended bore;

said adjustable nozzle includes an elongated cylindrical mount with a shaft-like member at one end and a central longitudinal axis with said open-ended bore offset therefrom;

a cap having a recess for insertably receiving said shaft-like member so as to be rotatably mounted thereon;

means cooperatively disposed between said shaft-like member and said cap for releasably connecting said cap to said shaft-like member.

* * * * *